United States Patent [19]

Cuschera

[11] 4,329,744

[45] May 18, 1982

[54] SHOWER RECEPTOR DRAIN

[76] Inventor: Casper Cuschera, Casper's Industries, Inc. 1047 77th Ave., Oakland, Calif. 94621

[21] Appl. No.: 190,916

[22] Filed: Sep. 26, 1980

[51] Int. Cl.[3] ..... E03C 1/26

[52] U.S. Cl. ..... 4/292; 4/286; 4/613; 4/252 R

[58] Field of Search ..... 4/292, 286, 288, 289, 4/290, 291, 293, 613, 615, 252 R; 285/56, 42, 57, 368, 58

[56] References Cited

U.S. PATENT DOCUMENTS

| | | | |
|---|---|---|---|
| 412,195 | 10/1889 | Marker | 4/289 |
| 2,780,303 | 2/1957 | Yonitch | 4/615 |
| 2,859,452 | 11/1958 | Seewack | 4/613 |
| 3,745,594 | 7/1973 | Casper | 4/292 |
| 3,967,326 | 7/1976 | Tammen | 4/252 R |
| 4,052,759 | 10/1977 | Hill | 4/252 R |
| 4,123,810 | 11/1978 | Oropallo | 4/292 |
| 4,161,043 | 7/1979 | Flores | 4/292 |
| 4,207,632 | 6/1980 | Sowell, Jr. et al. | 4/613 X |

*Primary Examiner*—Henry K. Artis

*Attorney, Agent, or Firm*—Harris Zimmerman; Howard Cohen

[57] ABSTRACT

A shower receptor drain assembly includes a generally cylindrical drain body having a flange extending upwardly from the upper end thereof. An inner flange extends radially inwardly from the lower edge of the drain body, and is provided with an inner diameter which permits a waste discharge pipe to extend upwardly therein. A plurality of bosses extend upwardly from the inner flange and are spaced equally thereabout. An annular sealing gasket is disposed within the drain body and received about the upper end of the waste discharge pipe. A compression ring is disposed directly superjacently of the sealing gasket, and a plurality of screws extend through the ring and through aligned passages in the gasket to be retained in tapped holes in the plurality of bosses. The screws cause compression of the sealing gasket to effect a leak-proof seal of the waste pipe within the drain body. The gasket includes a plurality of recesses in the lower edge thereof which are self-aligning with the bosses extending upwardly from the inner flange.

10 Claims, 3 Drawing Figures

SHOWER RECEPTOR DRAIN

BACKGROUND OF THE INVENTION

The following patents comprise the closest known prior art:

U.S. Pat. No. 412,195
U.S. Pat. No. 3,967,326
U.S. Pat. No. 4,052,759
U.S. Pat. No. 4,059,289

As shown in the references enumerated above, it is known in the prior art to join a drain and a waste discharge pipe by means of a resilient gasket which effects a leak-proof seal therebetween. Also, prior art shoows various means for compressing the gasket longitudinally to effect a radial expansion of the gasket so that the seal between the drain and the pipe is formed.

Generally speaking, the means for compressing the sealing gasket comprises threaded members which are secured to portions of the drain body and tightened to effect the longitudinal compression of the gasket. Often, the threaded members, such as screws or bolts, must be secured in tapped holes which are accessible only from the underside of the drain assembly. Gaining access to the underside of the drain may be extremely difficult, especially when the drain has been installed in the floor or bottom panel of a shower installation.

In other drain constructions of this type the threaded members must be introduced through narrow holes and secured in tapped holes at the lower end of the drain assembly. In this circumstance there is no means to guide the threaded member into the tapped hole, and the assembly of the threaded members in the tapped holes is attempted by reiteration and accomplished by chance. A great deal of time and labor is often wasted in assembling such devices.

SUMMARY OF THE PRESENT INVENTION

The present invention generally comprises a shower receptor drain which features a self-caulking gasket arrangement. The salient feature of the gasket arrangement is that it is far easier to install than any comparable prior art device.

The shower receptor drain of the present invention includes a generally cylindrical drain body having a flange extending radially outwardly from the upper end thereof. The drain body is adapted to be secured in a drain hole in a floor or in a bottom panel of a shower enclosure. An inner flange extends radially inwardly from the lower edge of the drain body, and defines an axially disposed bore. The diameter of the bore is slightly greater than the diameter of a waste discharge pipe, the upper end of which extends through the bore into the drain body. A plurality of bosses project upwardly from the inside surface of the inner flange, and each boss is provided with a tapped hole which extends therethrough parallel to the axis of the drain body.

The drain assembly also includes an annular sealing gasket disposed concentrically within the drain body and about the upper end of the waste discharge pipe. The sealing gasket includes a plurality of annular ribs formed on the inner and outer surfaces thereof, as well as a plurality of recesses formed in the lower edge of the gasket and spaced circumferentially thereabout. Each of the recesses is adapted to engage one of the bosses extending upwardly from the inner flange of the drain body. The sealing gasket also includes a like plurality of screw holes extending longitudinally therethrough parallel to the axis thereof, each of the screw holes extending to one of the recesses in the lower edge of the gasket.

A compression ring is disposed directly atop the sealing gasket, and is provided with a central aperture therethrough which is slightly larger in diameter than the diameter of the waste discharge pipe. A like plurality of holes are provided in the compression ring, and a like plurality of screws extend through the holes in the compression ring and through the longitudinal holes in the sealing gasket to be engaged in the tapped holes provided in the bosses. As the screws are tightened the sealing gasket is compressed longitudinally and caused to expand laterally in the narrow annular space between the upper end of the waste pipe and the inner surface of the drain body. As a result, a leak-proof seal is effected between the drain body and the waste pipe.

A salient feature of this invention is the provision of the recesses in the lower edge of the sealing gasket. When the gasket is introduced into the drain body during installation, the gasket may be rotated slightly so that the recesses in the lower edge engage the bosses projecting upwardly from the inner flange. This action causes the screw holes which extend through the gasket to be aligned with the tapped holes in the bosses. The compression ring is then placed over the sealing gasket, and the screws are inserted through the ring and through the gasket and threaded into the tapped holes. The engagement of the recesses of the gasket with the bosses of the drain body causes the screw holes to be aligned with the drain body, so that no time or labor is wasted in assembly of the device.

DESCRIPTION OF THE PREFERRED EMBODIMENT

Figure 1:
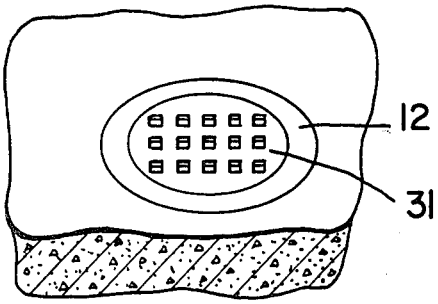
FIG. 1 is a top perspective view of the shower receptor drain of the present invention.
Figure 2:
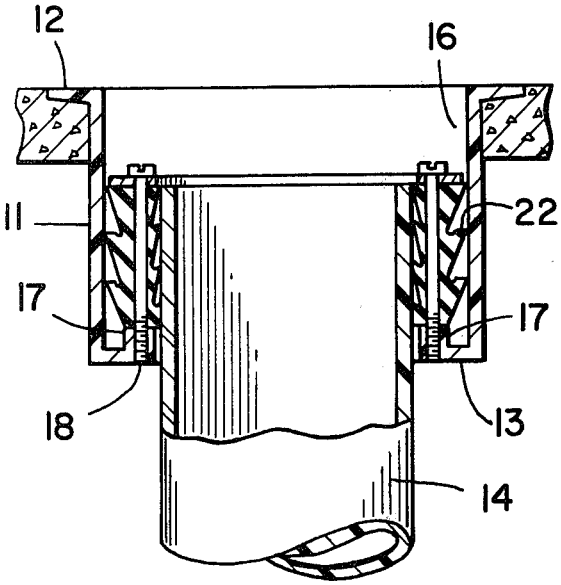
FIG. 2 is a cross-sectional elevation of the shower receptor drain of the present invention.
Figure 3:
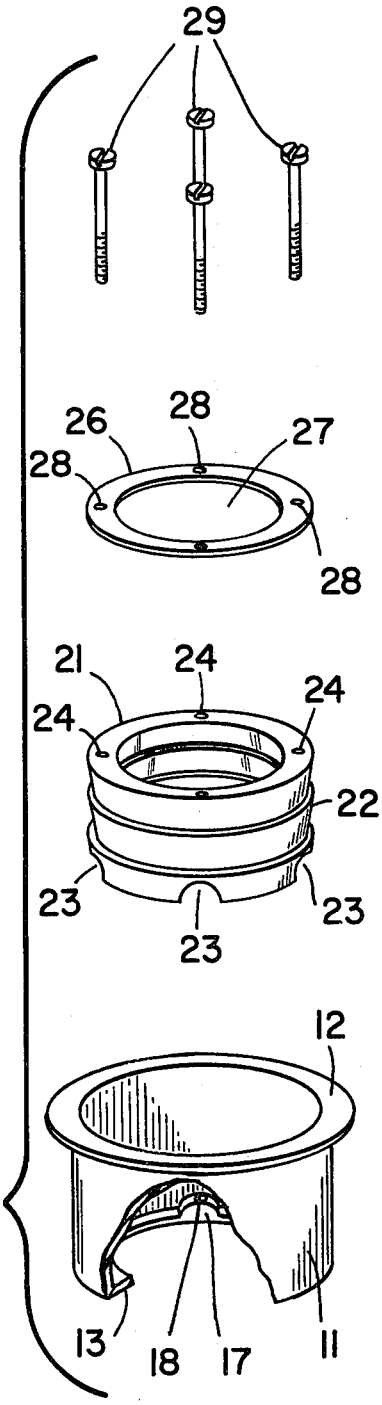
FIG. 3 is an exploded view of the components of the shower receptor drain of the present invention.

With reference to the accompanying figures, the shower receptor drain of the present invention includes a generally tubular, hollow cylindrical drain body 11 having a flange 12 extending radially outwardly from the upper edge thereof. The drain body 11 also includes an inner flange 13 extending radially inwardly from the lower edge thereof. The inner diameter of the flange 13 defines a bore through which the upper end of a waste discharge pipe 14 is received. An annular gap is defined by the inner surface 16 of the drain body 11 and the outer surface of the upper end of the waste discharge pipe 14.

Extending upwardly from the inner flange 13 is a quartet of bosses 17. The bosses 17 are spaced equally about the flange 13, and extend generally parallel to the axis of the drain body 11. Each of the bosses 17 is provided with a tapped hole 18 extending longitudinally therethrough.

The invention also includes a generally cylindrical, hollow sealing gasket 21, the gasket being provided with a plurality of annular ribs 22 on the interior and exterior surfaces thereof. The gasket 21 is also provided with a quartet of recesses 23 disposed in the lower edge of the gasket and arranged to register with the bosses 17 of the drain body. A quartet of screw holes 24 extend longitudinally through the gasket 21, with the lower end of each hole 24 terminating at one of the recesses 23. The gasket 21 is formed of a resilient substance such as neoprene rubber or the like.

A compression ring 26 is disposed to impinge upon the upper surface of the sealing gasket 21. The ring 26 is provided with a central aperture 27 which is slightly larger in diameter than the diameter of the waste discharge pipe 14. The ring 26 also includes a quartet of longitudinal screw holes 28 which are positioned to align with the screw holes 24 of the gasket 21. The compression ring 26 may be formed of a form-retaining material such as metal or rigid plastic.

The shower receptor drain also includes a quartet of screws 29 which are adapted to be received through the holes 28 of the ring 26, the holes 24 of the gasket 21, and to be secured in the tapped holes 18 of the bosses 17.

To install the shower receptor drain of the present invention, the drain body 11 is first secured in a suitably formed hole in the floor or bottom panel of a shower enclosure. The waste pipe 14 is then extended through the bore opening at the lower end of the body. The sealing gasket 21 is then inserted into the drain body and disposed in the annular space between the outer surface of the upper end of the waste pipe and the inner surface of the drain body. A slight rotation of the gasket 21 will cause the recesses 23 to register with and engage the bosses 17 of the drain body. This action will also cause the screw holes 24 in the gasket to become aligned with the tapped holes 18 of the bosses.

The compression ring 26 is then placed atop the ceiling gasket 21 with the screw holes 28 aligned with the holes 24 in the gasket. The screws 29 are then introduced through the holes 28 of the ring 26 and the holes 24 of the gasket 21, and are threaded into the tapped holes 18 of the bosses 17. As the screws 29 are tightened the gasket 21 is compressed longitudinally and caused to expand radially outwardly and inwardly. As a result, the annular ribs 22 are driven compressively to impinge upon the walls of the drain body and the discharge pipe, thereby effecting a leak-proof seal therewith. If desired, a strainer unit 31 may be secured in the top opening of the drain body 11.

It may be noted that assembly and installation of the shower receptor drain of the present invention is extremely simple and quick. This is due to the simplified construction of the present invention, and in particular it is due to the provision of the recesses 23 which engage and align with the bosses 17 of the drain body. As a result, the screw holes are automatically aligned with the tapped holes, and no time is wasted in attempting to introduce the screws 29 into the tapped holes. Also, the drain of the present invention easily may be disassembled and reassembled without necessitating replacement of any of the components thereof. Thus maintenance and repair of a plumbing system employing the drain of the present invention is made more simple and less expensive.

I claim:

1. A drain assembly, comprising: a generally cylindrical drain body having a bore extending therethrough, a first flange extending radially inwardly in said bore and defining an opening through which a pipe end portion extends, an annular resilient sealing gasket disposed in said bore adjacent to said flange and received about said pipe end portion, a compression ring disposed in said bore adjacent to said sealing gasket, means for joining said compression ring and said first flange with said gasket therebetween to effect axial compression of said gasket, and means for aligning said gasket and said drain body in a predetermined angular relationship in which said means for joining may be engaged.

2. The drain assembly of claim 1, wherein said means for joining said compression ring and said flange include a plurality of screws extending between said compression ring and said flange.

3. The drain assembly of claim 2, further including a plurality of screw holes extending longitudinally through said gasket, said screws being received through said screw holes.

4. The drain assembly of claim 2, further including a plurality of tapped holes disposed in said flange and adapted to secure said plurality of screws.

5. The drain assembly of claim 1, wherein said means for aligning includes a plurality of bosses extending from said flange, and said gasket includes a plurality of notches in one end thereof to register with and engage said bosses.

6. The drain assembly of claim 5, further including a plurality of tapped holes, each extending through one of said bosses.

7. The drain assembly of claim 6, further including a plurality of screw holes extending longitudinally through said gasket, each aligned with one of said notches.

8. The drain assembly of claim 7, further including a plurality of screws extending from said compression ring through said screw holes and secured in said tapped holes.

9. The drain assembly of claim 1, further including a second flange extending radially outwardly from said drain body.

10. The drain assembly of claim 9, wherein said first and second flanges are disposed at opposed ends of said drain body.

* * * * *